United States Patent [19]

Manchak, Jr. et al.

[11] Patent Number: 5,008,045

[45] Date of Patent: Apr. 16, 1991

[54] METHOD AND APPARATUS FOR CENTRIFUGALLY CASTING HAZARDOUS WASTE

[75] Inventors: Frank Manchak, Jr.; Frank E. Manchak, II; Michael E. Manchak; Peter J. Manchak, all of Goleta, Calif.

[73] Assignee: Alternative Technologies for Waste, Inc., Goleta, Calif.

[21] Appl. No.: 384,087

[22] Filed: Jul. 21, 1989

Related U.S. Application Data

[63] Continuation-in-part of Ser. No. 328,020, Mar. 23, 1989.

[51] Int. Cl.[5] ..... G21F 9/12

[52] U.S. Cl. ..... 252/633; 252/626; 252/628; 250/506.1; 264/311; 264/36; 264/D69; 425/262; 425/426; 425/427; 494/66; 494/85

[58] Field of Search ..... 264/311, 36, D69; 252/626, 628, 633; 250/506.1; 494/66, 85; 425/262, 426, 427

[56] References Cited

U.S. PATENT DOCUMENTS

| | | | |
|---|---|---|---|
| 1,828,916 | 10/1931 | Whitson | 425/426 |
| 2,283,735 | 5/1942 | Hume | 425/426 |
| 2,829,418 | 4/1958 | Triswell | 425/426 |
| 4,230,660 | 10/1980 | Taylor et al. | 264/311 |
| 4,274,962 | 6/1981 | Queiser et al. | 210/257.1 |
| 4,392,805 | 7/1983 | Golyak et al. | 425/426 |
| 4,477,373 | 10/1984 | Gantham et al. | 252/262 |
| 4,581,163 | 4/1986 | Meiniger et al. | 252/633 |
| 4,659,511 | 4/1987 | Fukasawa et al. | 252/628 |
| 4,681,705 | 7/1987 | Robertson | 252/631 |
| 4,844,855 | 7/1989 | Omori et al. | 264/311 |

*Primary Examiner*—Brooks H. Hunt
*Assistant Examiner*—Ngoclan T. Mai
*Attorney, Agent, or Firm*—Roth & Goldman

[57] ABSTRACT

A casting containing toxic waste is made by centrifugally casting toxic waste in a pre-formed cage having heat conducting means therein. The casting is formed with suitable shielding materials selected as a function of the waste being cast. The finished casting may contain passageways through which heat is removed. These passageways are oriented such that when two or more castings are stacked in abutment, the passageways of adjacent castings interconnect. Also disclosed is a method and apparatus for forming castings of polygonal exterior cross section having a contaminant barrier wall of substantially uniform thickness so that the waste storage volume of the castings is maximized and so that the castings may be stacked and stored in honeycomb fashion in a respository to minimize dead storage space.

10 Claims, 4 Drawing Sheets

FIG. 5
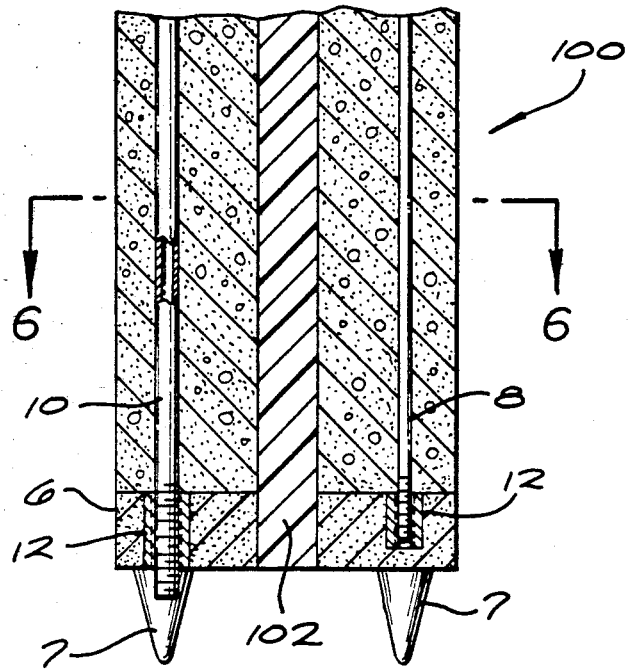
FIG. 6
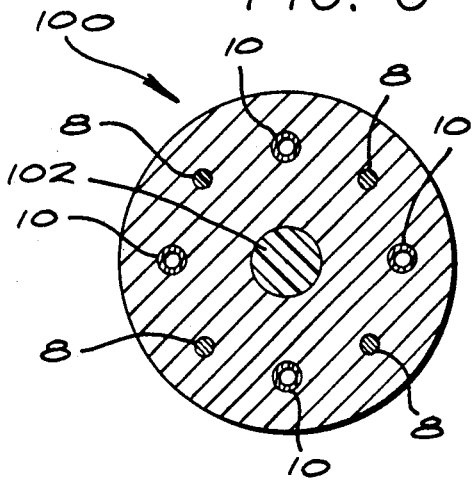
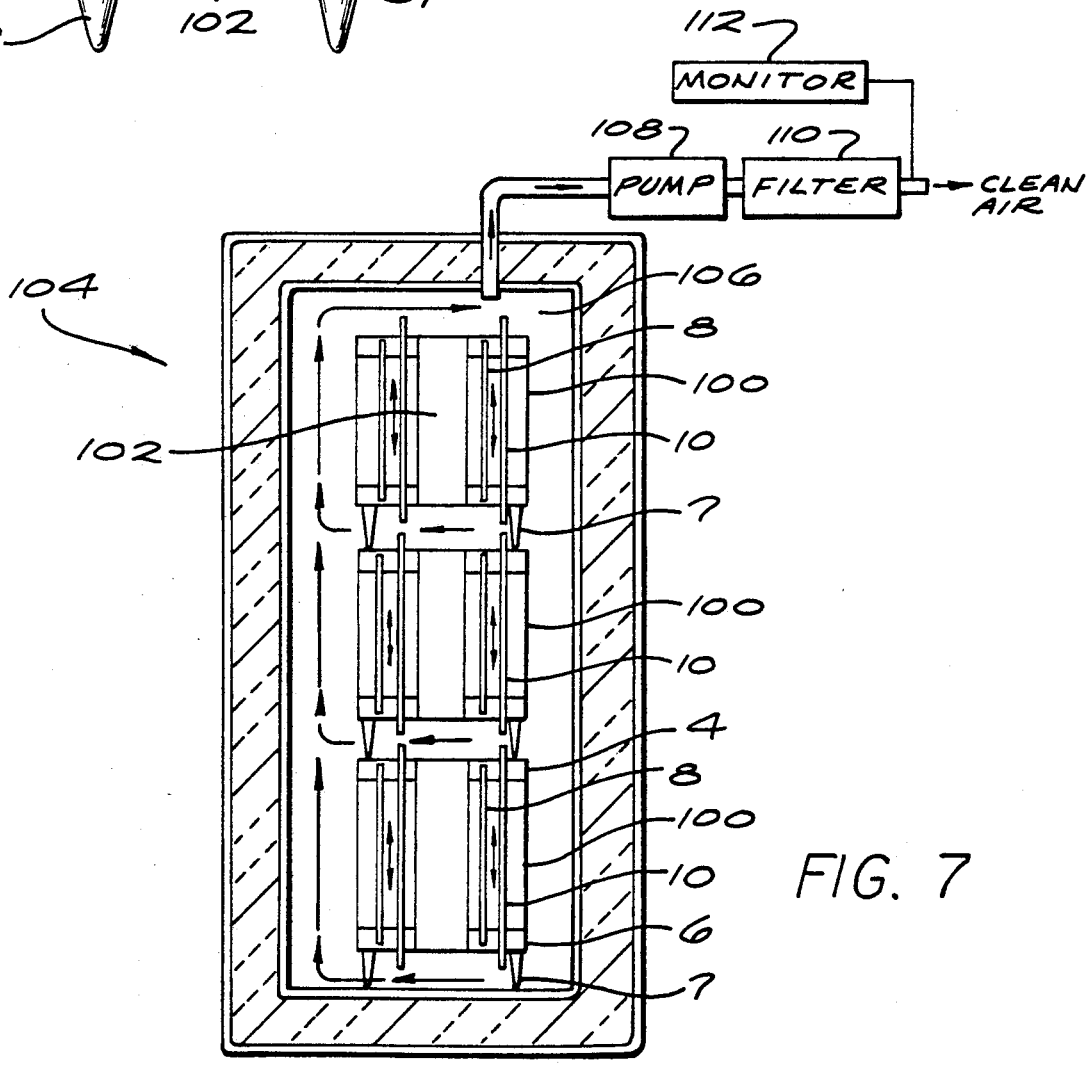
FIG. 7

METHOD AND APPARATUS FOR CENTRIFUGALLY CASTING HAZARDOUS WASTE

CROSS REFERENCE TO RELATED APPLICATIONS, IF ANY

This application is a continuation in part of our co-pending application Ser. No. 07/328,020 filed Mar. 23, 1989.

BACKGROUND OF THE INVENTION AND PRIOR ART

This invention relates to casting toxic waste for burial or other suitable isolation. The cost of burying or isolating toxic wastes is increasing at an alarming rate due in part to stringent government regulations and sound environmental policy which dictate that toxic wastes cannot be simply dumped in a standard landfill.

Techniques for separation and isolation of mixed waste, particularly low-level radioactive wastes (LLRW) mixed with other hazardous constituents, are discussed in detail in co-pending U.S. patent application Ser. No. 07/160,814 filed Feb. 26, 1988 now U.S. Pat. No. 4,897,221, by Frank Manchak, Jr.

Some particularly hazardous toxic wastes, such as those wastes which are radioactive, must be stored in environmentally sound containers to effectively isolate the waste from the environment. These containers are often then stored in remote burial sites, suitable repositories or vaults. The use of standard metal drums or containers as containers for toxic waste is well known in the prior art. These drums are inappropriate for use with certain mixed wastes containing radioactive materials, and chemicals listed in 40 CFR Part 261, such as corrosives.

Since low level radioactive waste (LLW) and transuranic waste (TRU) must be isolated for up to hundreds of years, the containers holding these wastes must last as long regardless of whether they are subjected to corrosive action from the contents within the containers or from the exterior environment such as salt water or other chemical attack which is frequently present in underground storage vaults.

Radioactive waste must be isolated with adequate shielding to protect persons handling the waste and the environment. The type of shielding required depends on the type of radiation emitted by the waste. The following are encountered:

Fast Neutrons:

Fast neutrons are those neutrons with energies roughly above 100,000 eV (electron volts). Hydrogen nuclei are an effective shielding material for fast neutrons.

Water is a good source of hydrogen, but it is not suitable for use as a long term shield in its free liquid form because of the danger of leaks. Concrete is also effective as a shield for fast neutrons because the bound water in concrete is a source of hydrogen nuclei and functions as a shielding agent.

Another suitable shielding material is polyethylene which contains more hydrogen atoms per cubic centimeter than any other substance.

Thermal Neutrons:

Thermal neutrons are those neutrons with energies roughly below 0.025 eV. The most effective way to stop thermal neutrons is to shield with $B^{10}$ (Boron$^{10}$). $B^{10}$ may be mixed in its pure form directly with the waste, or it may be added in its powdered form to concrete to be used as a containment vessel for radioactive wastes. $B^{10}$ may further be suspended in polyethylene to form a combined shield for fast and thermal neutrons.

Gamma Rays:

Gamma rays are quanta of electromagnetic wave energy having wavelengths from 0.005 to 1.40 Angstroms. Gamma rays are best shielded by elements with high atomic numbers.

Alpha and Beta Radiation:

An alpha particle is identical with the nucleus of the helium atom and consists therefore of two protons plus two neutrons bound together. A beta particle is identical with an ordinary electron. Both alpha and beta particles are strongly ionizing when moving and so lose energy rapidly in traversing through matter. Most alpha particles will traverse only a few centimeters of air before coming to rest. While more shielding is generally necessary to stop beta particles than is required to stop alpha particles, most standard containers manufactured to isolate waste would provide sufficient shielding for both alpha and beta radiation.

Much of the high cost of burying or otherwise isolating toxic waste comes not directly from the mass of the waste, but rather from its volume. Space in suitable repositories is limited, so waste and shielding material must be packed as tightly as possible. There are various techniques currently used to compact toxic waste for isolation. Screw compactors are one of the most common waste volume reduction devices, and at the federal facility at Oakridge Tenn., a 100 ton compactor is used to crush or compact waste filled containers to reduce the volume thereof. The crushed waste containers must then be isolated in a suitable repository. The volume reduction capabilities of different compaction methods varies, but none of them is able to approach compaction to the maximum possible density. Further reduction in the volume of the repository or storage space required can be obtained if the wastes are compacted into non-cylindrical containers such as hexagonal or octagonal shapes which can be placed or stacked adjacent each other in honeycomb fashion to eliminate useless dead space which occurs between adjacently placed cylindrical containers.

Centrifugal castings are very dense, and heat produced in the casting by chemical reactions of toxic organic or inorganic wastes or by radioactive decay causes various problems. Heat is often produced by exothermic reactions in waste and the rate at which heat is produced in a mass of radioactive waste is generally related to the density of the wastes contained in a container thereof.

In a densely cast mixture of toxic waste, a symmetrical casting is ordinarily hottest in its center, and its temperature decreases towards its outer periphery. Without the provision of means for removing heat from the castings, extreme temperature gradients existing between the center of the casting, and its outer periphery are likely to cause the casting to crack due to thermal stresses. Also, shielding materials such as polyethylene will chemically degrade and not perform the shielding function if the temperature of the casting rises above about 400° F.

Most underground repositories, or vaults for storing radioactive wastes have been placed in rock formations deep below the earth's surface. The heat which is produced by the reactive wastes stored in these vaults builds up to intolerable levels because it can not dissipate through the surrounding rock. If this heat is not removed, the temperature of the entire underground repository will rise beyond a level where human beings cannot work and containers of radioactive waste will melt or crack, thus releasing radioactivity. Also, any volatile components present in the radioactive waste will volatilize, and can easily carry radiation into the water table or atmosphere.

OBJECT OF THE INVENTION

It is therefore an object of the present invention to provide a method and apparatus to densely compact mixtures of radioactive waste, toxic waste and shielding materials into a rigid form and to provide means for removing heat from the compacted form such that the compacted form does not crack due to thermal stresses.

It is a further object of the invention to provide a method and apparatus for casting non-cylindrical shapes of mixed hazardous waste.

SUMMARY OF THE INVENTION

The present invention accordingly provides methods and apparatus for centrifugally casting a castable mixture containing toxic waste and/or radioactive wastes into a stable casting of high density. The method involves selecting an outer castable shielding barrier of optimum composition and thickness for the specific waste to be isolated. Centrifugal casting is ideal for this purpose because in centrifugal casting, the thickness of the outer shielding barrier, as well as the materials from which the outer shielding barrier is formed, may be easily changed as the casting process progresses.

The method further enables easily varying the dimensions of the toxic waste casting by selecting a mold with the desired diameter, and by using different sized preformed blanks, or cages which are incorporated into and define the length and/or shape of the casting to allow castings to be easily custom built to minimize wasted dead space in a repository.

The methods and apparatus disclosed herein also provide for the efficient removal of heat from the finished castings and storage repository. Means are provided to maintain the temperature of the castings below critical temperatures above which concrete, if used in the casting, may crack or otherwise release radioactive materials or lose water of crystallization, and temperatures above which radioactivity shielding materials, such as polyethylene, may thermally degrade over time.

BRIEF DESCRIPTION OF THE DRAWING

FIG. 5 is a sectional view of a completed casting.

FIG. 6 is a cross section taken along line 6—6 of FIG. 5.

FIG. 7 is a diagrammatic view of the heat flow from stacked castings in a repository.

DESCRIPTION OF THE PREFERRED EMBODIMENTS

Figure 1:
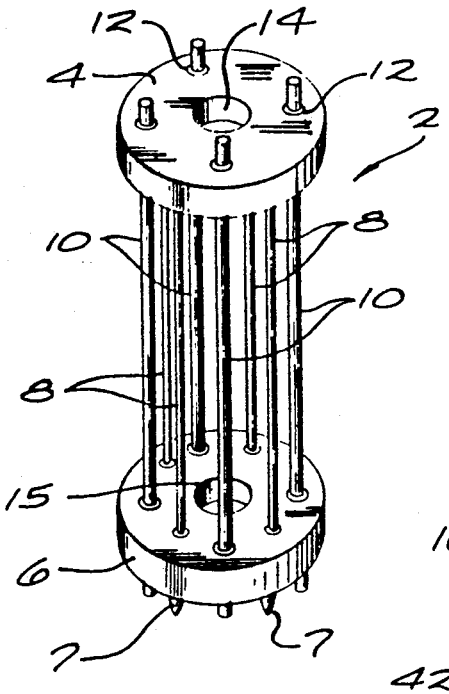
FIG. 1 is a perspective view of a first form of a precast reinforcing and heat removal cage used in centrifugal casting of hazardous waste.

FIG. 1 shows a consumable cage 2 which will become part of the casting of hazardous waste materials formed by centrifugal casting methods disclosed below. As shown, the cage 2 has a pair of spaced precast concrete disks, or end pieces 4, 6, the lower one of which may have feet 7 thereon for stacking the castings in a vertically spaced relationship. These end pieces 4, 6 will have boron or polyethylene or other suitable shielding materials cast therein in amounts adequate to shield radioactivity emissions from the wastes to be cast. Boron enriched polyethylene may be used as a combined shield. It will be appreciated by persons skilled in the art that, while cylindrical end pieces 4, 6 have been shown, other generally symmetrical shapes such as octagonal shapes can also be used. The precast end pieces 4, 6 are fastened together at a desired axial spacing from each other by a plurality of alternately spaced solid heat conductive reinforcing rods 8 and heat conducting conduits 10 of steel, ceramic material or graphite, arranged in a generally circular pattern. Advantageously, one end of each rod 8 and conduit 10 is provided with a right hand thread with the other end being provided with a left hand thread. The threaded rods 8 and conduits 10 are received in mating threaded inserts 12 best seen in FIG. 5. The inserts 12 for the conduits 10 are designed to allow the heat conduits 10 to extend entirely through the end pieces. The ends of the reinforcing bars 8 may be embedded within the end pieces 4, 6 or, like the conduits 10, may extend entirely through the end pieces 4, 6 for a purpose to be described. The threading on the conduits 10 and the inserts 12 in the end pieces 4, 6 is selected such that the conduits 10 can be easily affixed to both end pieces 4, 6 simultaneously by rotating the conduits 10 in the desired direction. The rods 8 may be similarly affixed to the end pieces 4, 6 if desired. End pieces 4 and 6 are each also provided with a circular central aperture 14, 15 for receiving a casting feed mandrel 16 which will be described below.

Our presently preferred heat conduits 10 comprise heat pipes, as that term is understood in the mechanical engineering field, with ammonia, water or other known working fluids. Heat pipes suitable for the intended purpose are commerically available from Thermacore, Inc. of Lancaster, Pa. It is to be understood that suitable heat conduits 10 could also comprise hollow piping.

Figure 2:
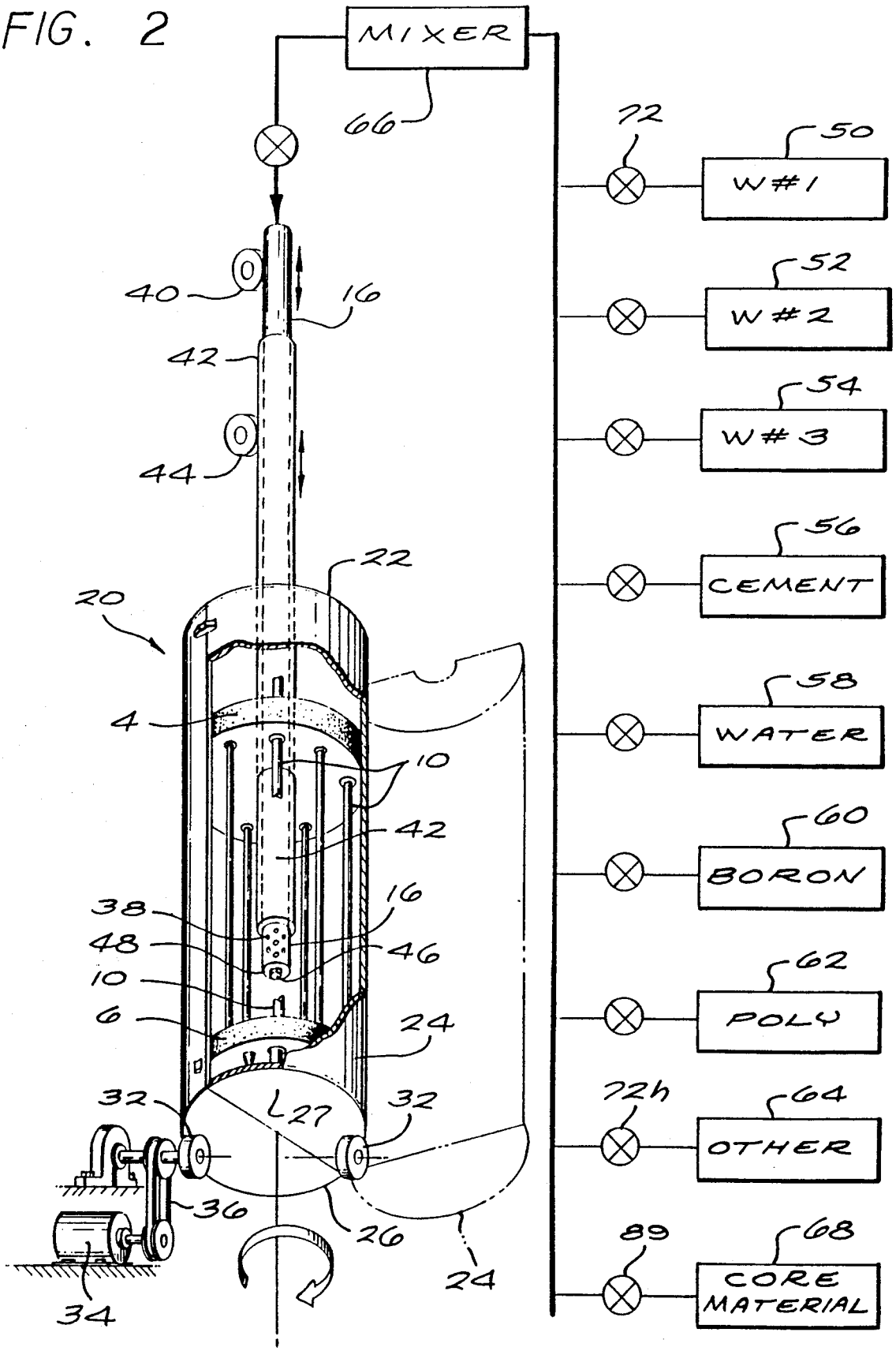
FIG. 2 is a schematic perspective view of a centrifugal casting apparatus which receives the cage of FIG. 1 preparatory to centrifugal casting of waste.

As seen in FIG. 2, the casting apparatus 20 comprises a vertically oriented cylindrical mold shell 22 preferably comprised of two halves 24, 26 which can be opened to the dash line position shown to receive a cage 2 of the selected length. It will be appreciated that the casting apparatus 20 may be long enough to produce castings having an axial length of approximately ten feet, although castings to be produced may typically have an axial length of only six feet with a diameter of three feet. The castings can, however, be made in any desirable length less than ten feet by simply using a cage 2 of the selected length.

The mold shell halves 24, 26 are hingedly connected and latched together when closed. A pair of disk shaped end pieces 25, 27 close the upper and lower ends of the mold 22. Upper end piece 25 may be omitted if desired. The entire mold 22 is driven by a roller drive 32 and can be rotated at speeds sufficient to create a centripetal acceleration at the periphery of the mold of about sixty times the acceleration due to gravity by a drive mechanism consisting of a motor 34 and power transmission 36.

As shown, the elongated, generally cylindrical feed mandrel 16 extends centrally through the central aperture 14 in the upper end piece 4 of the casting apparatus 20 and is provided with a plurality of radial ports 38 for the discharge of castable materials into the interior of the rotatable casting apparatus 20. A mandrel drive mechanism 40 is shown schematically for longitudinally moving the elongated hollow mandrel 16 into and out of the cylindrical mold shell 22. It will be appreciated that the feed mandrel 16 could alternatively be arranged to feed castable materials into the mold at a location spaced radially from the axis of rotation of the mold so long as a suitable rotatable swivel fluid connection is used. Such an arrangement is disclosed below in connection of the casting apparatus shown in FIGS. 9 and 10 and may be desired if the prefabricated cage 2 is also provided with a central heat removal core 102 prior to commencement of the centrifugal casting as will be described below. When a core 102 is prefabricated with the cage 2, the feed mandrel 16 must be radially offset away from the core 102 and must extend downwardly into the mold shell 22 either through a radially offset aperture (not shown) in the upper end piece 4 of the cage 2 or into a radial clearance space left between the periphery of the upper end piece 4 and the interior wall surface of the mold shell 22.

A mandrel sleeve 42 is telescopingly engaged with the hollow ported mandrel 16 and is separately moved longitudinally by a sleeve drive 44. In addition to radial ports 38 on the mandrel 16, an axially oriented central core casting port or ports 46 are also provided at the lower end 48 of the mandrel 16 which is inserted into the mold shell 22. Presently, we prefer to use a pre-cast heat conducting central core 102 manufactured of carbon and epoxy, or ceramics. This core 102 may be provided as an integral part of cage 2. Alternatively, a removable plug may be placed in the casting mold 22 before casting commences. After casting is completed, the plug is removed and replaced with a pre-cast heat conducting core 102. Alternatively, the core 102 may be cast in the mold 22, as explained in detail below.

The materials to be cast in the centrifugal casting apparatus are stored in one or more separate containers of hazardous waste 50, 52, 54, Portland cement 56, water 58, radioactivity shielding materials such as boron pellets 60, polyethylene 62 or other types of shielding materials 64 to be intimately mixed in a hopper 66 in selected portions. Also shown as an option to the use of a precast central core is a container 68 of castable ceramic core material to be injected into a central hollow void space which remains in the casting after the feed mandrel 16 is removed to form a core 70. A plurality of valves 72*a–h*, 89 control the discharges from the various sources of casting feed and, as will be appreciated by those skilled in the art, such valves 72*a–h* can be remotely controlled electronically so that the composition and the thickness of the shielding materials and hazardous wastes can be accurately measured and controlled as desired.

The thickness of concrete to be used as an outer barrier and the proportions of radioactivity shielding material therein depends greatly on the properties of the radioactive waste to be cast. The American Nuclear Society has published guidelines on the analysis and design of concrete radiation shielding. These guidelines were approved by the American National Standards Institute, Inc. (ANSI), and are available as ANSI/ANS-6.4-1985.

Figure 3:
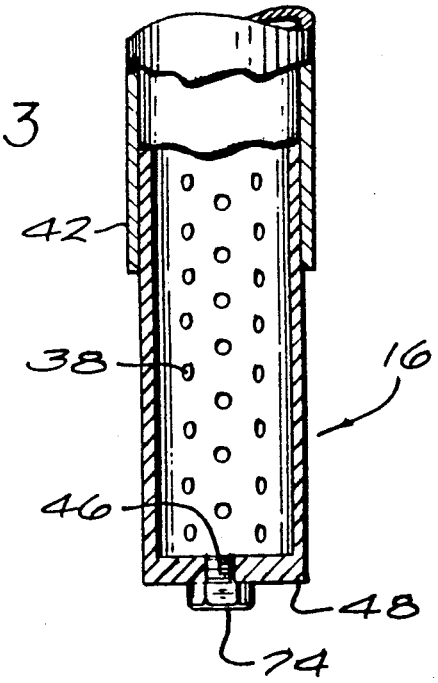
FIG. 3 is a detail view of the injection feed mandrel used with the casting apparatus of FIG. 2.
Figure 4:
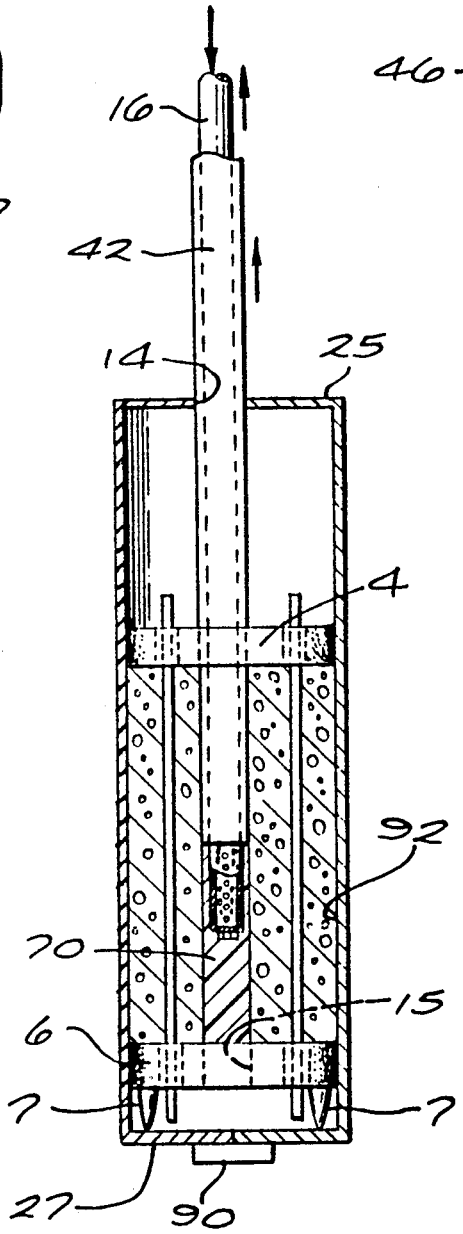
FIG. 4 is a sectional view of centrifugal casting apparatus mandrel shown in FIG. 2.

The details of the injection mandrel 16 are best seen in FIGS. 3 and 4. The mandrel 16 is provided with a plurality of radial injection ports 38 which have been uncovered by partial withdrawal of the mandrel sleeve 42. A manually removable plug 74 is provided at the axial end 48 of the mandrel 16 for opening the port 46 therein which is used for the discharge of castable carbon and epoxy, or ceramic heat conductive central core material, when desired. Since a cylindrical mandrel aperture 14, 15 has been left at either end of the precast, consumable cage 2, a temporary cover 90 is provided which is removably affixed to the mold end piece 27 in any convenient manner after opening of the mandrel plug 74 so that the castable ceramic material will not escape through end piece 6 of the casting as it is injected into the hollow central core 70. The mandrel 16 is removed from the top end of the central core 70 as the castable ceramic material is injected into the bottom end of the hollow core 70 and gradually fills same.

Finished castings 100 may be vertically stacked in a repository vault as seen in FIG. 7 and are spaced from each other by the feet 7. Although it is possible to use heat removal conduits 10 which are hollow and may be aligned for continous unidirectional flow of heat transfer fluid therethrough, we presently prefer to use heat pipes which are believed more economical and efficient. Since the heat flow in heat pipes may be bi-directional with heat being removed from either end of each casting 100 as shown by the heat flow arrows, we presently prefer to stack the castings 100 in the repository with a sufficient vertical spacing therebetween so as to permit heat removal from the exposed ends of the heat pipes. The exposed ends of the heat pipes transfer heat laterally to vertically extending heat removal spaces between or alongside of the castings by forced air currents as shown by the heat flow arrows in FIG. 7.

OPERATION OF THE EMBODIMENT OF FIGS. 1–7

For the casting of hazardous materials to be disposed of, the cylindrical mold shell halves 24, 26 are unlatched and opened. Subsequently, a precast, consumable cage 2 of the desired length, which may or may not also have a pre-cast central core 102 therein, is deposited in the casting mold shell 22 adjacent the lower end piece 27. The mold shell 22 is then closed to hold the cage 2 in the desired position by clamping engagement with the mold shell 22 which is then latched and subsequently brought to the desired speed of rotation by the drive motor 34 and power transmission 36. Next, the feed mandrel 16 and sleeve 42 are simultaneously longitudinally moved into the rotating mold 22 and through the mandrel aperture 14 of the upper end of the cage 2. The sleeve 42 is then retracted from the mandrel 16 a distance equal to the axial length of the cage 2 so as to expose mandrel ports 38 extending axially between the spaced parallel end pieces 4, 6 of the precast cage 2. Subsequently, the appropriate valves 72*a–h* are opened to transmit the castable materials under pressure into the mandrel 16 where they are radially ejected from the mandrel ports 38 and centrifugally cast against the inner walls 92 of the rotating cylindrical mold shell 22. After the desired outer layer thickness of mixed concrete and shielding materials has been attained, the valves 72*a–h* are adjusted to transmit a mixture of the hazardous materials to be cast in the rotating cage 2. If desired, the radially innermost layer of the casting is completed by again using a higher proportion of concrete and shielding materials.

While FIG. 2 shows a centrifugal casting apparatus 20 designed to rotate about the longitudinal axis of the mold shell 22, mold shell 22 may also be caused to rotate such that its ends oscillate about an axis perpendicular to its longitudinal axis. A centrifugal casting apparatus having multi-axis rotation is of particular advantage when casting shapes other than cylindrical castings—e.g. castings having hexagonal or octagonal cross sections. A suitable multi-axis centrifugal casting apparatus is manufactured by FSP Machinery Co. of Winkler, Manitoba, Canada.

Upon completion of the casting process, the mandrel 16 and sleeve 42 are removed from the mold shell 22, and rotation of the cylindrical mold shell 22 is terminated. A pre-cast heat conductive core 102 is inserted into the void left by removal of the mandrel 16, and sleeve 42.

While the casting has been described as having an outer layer of shielding materials with toxic waste contained therein, persons skilled in the art will appreciate that the casting could be formed as a homogeneous mass of toxic waste and shielding materials and that shapes other than cylindrical can be centrifugally cast if desired.

If it is desired to form the central heat removal core 102 by casting, upon completion of the centrifugal casting process, the sleeve 42 is moved downwardly to completely cover the radial ports 38 in the mandrel 16 and rotation of the cylindrical mold shell 22 is terminated. The mandrel end plug 74 is then opened exposing the axial port 46 at the lower end of the mandrel 16 and, subsequently, the temporary cover 90 is affixed to close the aperture 15 at the lower end of the cylindrical mold shell 2 and end of the casting. Finally, the valve 89 is opened to permit castable ceramic material to discharge through the mandrel 16 where it is ejected from axial port 46 in the end of mandrel 16 against the temporary cover 90. Pressure buildup caused by the injection process assists in axially withdrawing the mandrel 16 and sleeve 42 simultaneously from the mold shell 22. The ceramic core injection is terminated when the mandrel 16 and sleeve 42 have been withdrawn a distance equal to the axial length of the mold shell 22.

The completed casting 100 is then removed from the mold shell 22 and, as seen in FIGS. 5 and 6, the completed casting 100 has both ends of heat conduits 10 which comprise heat pipes, and the central ceramic core 102 exposed so that, when stacked as shown in FIG. 7, the heat conduits 10 and central core 102 can be arranged to permit heat removal from the exposed ends of the heat conduits 10 and the central core 102 by forced air currents to air space 106.

Since hollow conduits or solid bars, rather than heat pipes, may be used as heat conduits 10, the heat conduits 10 and central cores 102 in vertically adjacent stacked castings can be arranged in direct contact with each other for efficient heat transfer relationship with each other to remove the generated heat upwardly through the conduits in the vertically adjacent castings rather than laterally through the spaces left by the feet 7 thence upwardly into air space 106.

It has been estimated that even after thirty years of isolation in a repository, nuclear waste may still release heat flow of the order of magnitude about ninety times the normal heat flow through the earth. Unless heat is adequately removed, waste containing strata will rise in temperature until long term equilibrium is reached and the heat generated by the repository 104 equals heat flow to the earth's surface.

It is thus important to provide for regular and efficient heat removal from underground repositories. To this end, as seen in FIG. 7, heated air is removed from the air space 106 by a pump 108 and is passed through a High Efficiency Particle Air (HEPA) filter 110 so that the contaminant content of the air may be carefully monitored at 112 before it is discharged to the atmosphere.

It will be appreciated, that in some instances it will be desired to use a plurality of hollow heat conduits 10 and no solid reinforcing rods 8 to space the end pieces 4, 6 of the precast cage 2. Depending on the characteristics of the waste to be handled, a greater or lesser proportion of the axially arranged heat conduits 10 will be used instead of solid reinforcing bars 8.

THE EMBODIMENT OF FIGS. 8-10

Figure 8:
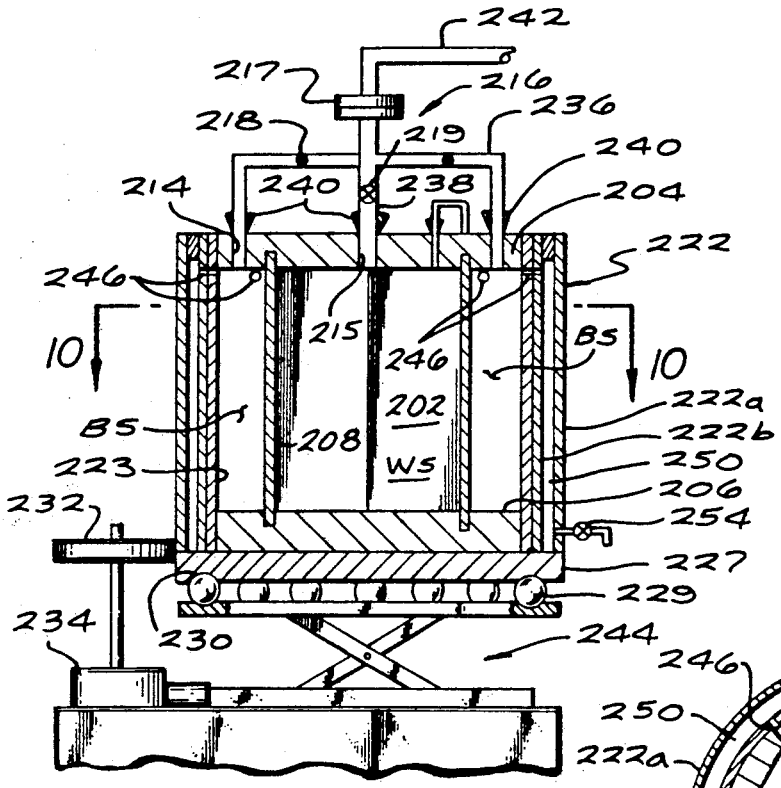
FIG. 8 is a cross sectional elevation view of a centrifugal casting apparatus for forming polygonal shaped castings and shows a second form of cage therein.
Figure 9:
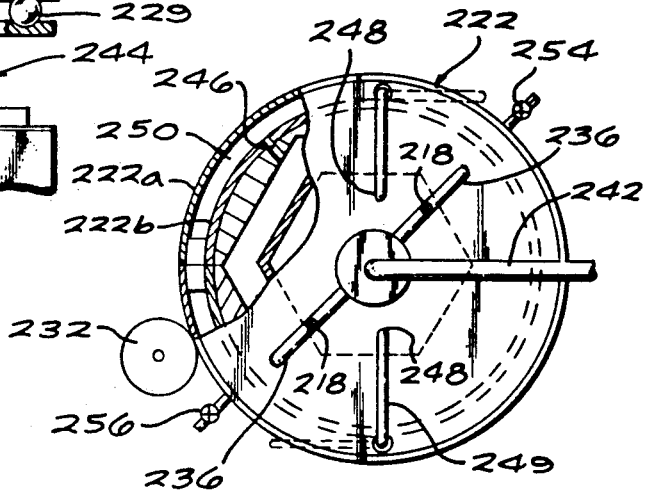
FIG. 9 is a top plan view of the apparatus of FIG. 8.
Figure 10:
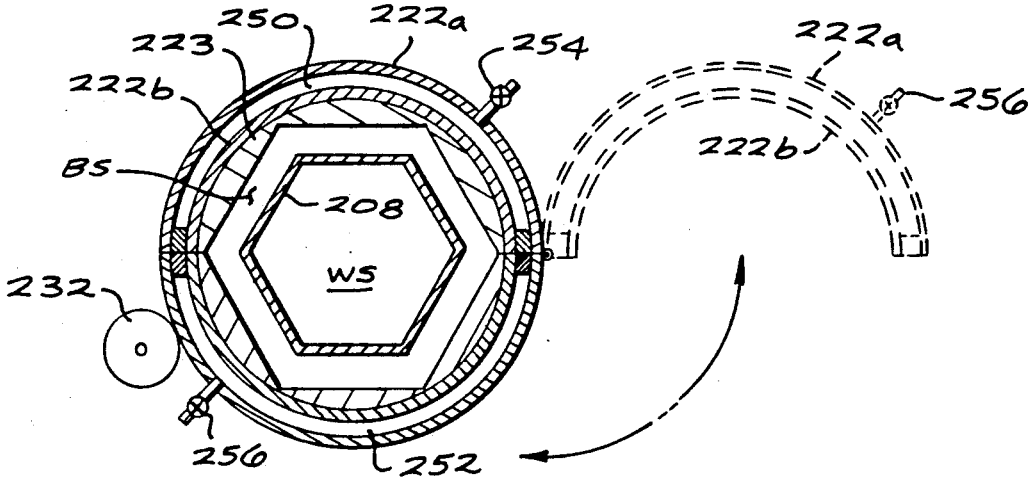
FIG. 10 is sectional top plan view, partly broken away, of the apparatus taken at lines 10—10 of FIG. 8.

FIGS. 8, 9 and 10 comprise schematic views of a molding apparatus for forming polygonal shaped castings. The apparatus receives a cage 202 having a pair of precast parallel end pieces 204, 206 of polygonal shape interconnected and held in spaced relation by a cage wall 208 also having a polygonal configuration when seen in cross section as in FIG. 10. End pieces 204, 206 are necessarily made of material and thickness designed to provide a contaminant barrier for hazardous wastes to be cast. The cage wall 208 need not be made of any particular material or be of any required thickness since it serves merely to provide a casting form outside of which an exterior contaminant barrier wall will be cast. Cage end pieces 204, 206 and cage wall 208 are shown as a hexagonal shape although it will be appreciated that other polygonal shapes can be constructed as desired.

Cage 202 is centrally placed in split or bifurcated hinged cylindrical double wall mold shell 222 which also has a split or bifurcated hinged mold liner 223 of shape complementary to that of cage 202 positioned therein. A hexagonal casting space BS of substantially constant wall thickness is disposed between cage wall 208 and liner 223 and above disc shaped mold bottom 227. Mold bottom 227 is welded or otherwise affixed to the lower end of spaced mold sidewalls 222*a* and 222*b* thereby leaving chambers 250, 252 therebetween for receiving excess castable fluid material. The mold apparatus is supported in a manner to permit rotation of the mold apparatus about a vertical axis on balls or rollers 229 which are arranged in a circular race or track 230. The open position of the mold shell 222 and liner 223 is shown in phantom in FIG. 10. One or more shielding material feed mandrel apertures 214 are provided in the upper end piece 204 of cage 202 in axial alignment with the contaminant barrier casting space BS. A centrally located aperture 215 is also provided in upper cage end piece 204 for reception of castable waste materials delivered from a material feed system 216.

Similar to the casting apparatus of FIG. 2, the material feed system 216 comprises a main feed conduit 242 connected to a swivel 217 which permits relative rotation between its upper and lower connections without fluid leakage, and valves 218, 219 in the locations shown for controlling flow of fluid materials through branch feed lines 236 and central feed line 238. Castable shielding material is fed through the radially extending branch feed lines 236 which have their lower discharge ends provided with expander seals 240 which are receivable in the apertures 214. Central feed line 238 similarly is provided with an expander seal 240 at its lower discharge end which is receivable in aperture 215.

Unlike the apparatus of FIG. 2, the branch feed lines 236 and central feed line 238 do not comprise telescoping feed lines and covering sleeves which are believed unnecessary since the cage wall due to the 208 is a solid peripheral wall instead of spaced reinforcement bars in FIG. 2. In the apparatus of FIGS. 8–10, the uniformity of wall thickness of the barrier material is accomplished by providing the barrier wall casting space BS of the desired constant wall thickness rather than by coating a desired thickness of the castable material onto the rotating mold wall followed by casting waste material directly against the barrier material.

The casting apparatus is rotatable about its vertically extending central axis by a roller 232 driven by a motor 234. An elevator 244 is provided to raise and lower the casting apparatus between a lower cage placement and casting removal position and an upper mold filling position. When in the upper position, the expander seals 240 at the discharge ends of the feed lines 236, 238 are received the apertures 214 and 215 and are sealed therein from leakage. When in the lower position, the bifurcated mold shell 222 and bifurcated mold liner 223 are opened by pivoting them about vertically extending hinges which interconnect the mold shell and mold liner parts for removal of a completed casting and for placement of a new consumable cage 202 inside the open mold liner 223.

OPERATION OF THE EMBODIMENT OF FIGS. 8–10

In operation, castable barrier shield materials are first cast into the constant wall thickness hexagonal space BS between the outside wall of cage 202 and mold liner 223 by opening valves 218 and closing valve 219, then commencing rotation of the mold and then discharging the castable contaminant barrier material into the barrier wall casting space BS of the rapidly rotating mold. After the barrier wall has been cast, rotation of the mold is stopped so that valves 218 can be closed and valve 219 can be opened following which the rotation of the mold is re-commenced and the castable waste material is introduced into a waste casting space WS through feed line 238. Air and excess fluid bleed passageway 246 are provided in the upper portion of the inner one **222*b* of the spaced walls 222 as best seen in FIG. 8 to vent the contaminant barrier wall casting space BS to the chambers 250, 252 between walls 222 during casting whereby excess liquid driven off by the centrifugal casting of a contaminant barrier wall may escape to and be retained in chambers 250, 252. Valved drains 254, 256 are provided as shown at the lower ends of chambers 250, 252** for removing excess fluid collected therein after termination of centrifugal casting.

Vent passageways 248 in the upper cage end piece 204 are provided for removal of excess toxic waste liquid which is forced during centrifuging to the upper end of the space into which toxic waste is cast. At least two flexible waste liquid removal conduits 249 are provided at the top of the mold and have their discharge ends disposed to discharge excess collected liquid waste into the chambers 250, 252 between walls **222*a* and 222*b*. If desired, a swivel connection may be provided at the discharge ends of conduits 249 whereby the conduits 249 may be swung in an arc between an operative position as seen in solid lines where the entrance ends of the conduits 249 are placed in fluid communication with the holes 248 and an inoperative out of the way position as shown in phantom in FIG. 9. The holes 248 and the mandrel apertures 214, 215 in the upper cage end piece 204** are subsequently plugged with barrier material after the casting is removed from the mold to complete the finished casting.

The centrifugal casting techniques and apparatus of FIGS. 8–10 herein enable the formation of polygonal shaped castings which can be nested together in honeycomb fashion in a repository so as to minimize or eliminate completely, the dead space which is found between cylindrical castings. It is ordinarily necessary to cast the outer contaminant barrier layer first and to subsequently cast the inner casting of hazardous castable waste since the side wall 208 of the cage is not intended to provide structural support during casting. Casting of the waste prior to casting of the contaminant barrier is possible but only provided that the cage is constructed of sufficient strength to resist outward bowing or bulging during the centrifugal casting. The contaminant barrier wall is of constant thickness so that a maximum volume of waste can be encapsulated therein. A constant thickness barrier wall can be formed only by the use of the cage 202 and mold liner 223 rather than by a mold liner alone since centrifugal casting in a mold liner 223 without a cage 202 results in a non-uniform thickness contaminant shielding barrier having a polygonal outer wall and inner cylindrical wall. For a selected minimum wall thickness, such a configuration results in less central cavity volume available for reception of castable hazardous waste material.

Heat removal means or structural reinforcement have not been shown in the castings of FIGS. 8–10 for clarity in illustration but it will be appreciated that heat removal means and/or reinforcement can be provided as part of the prefabricated cages if desired.

Persons skilled in the art will readily appreciate that various modifications can be made from the preferred methods and apparatus disclosed herein, thus the scope of protection is intended to be defined only by the limitations of the appended claims.

We claim:

1. A method of compacting hazardous waste materials into a stable rigid form comprising the steps of:

(a) placing a mold liner into a casting mold which is rotatable around a longitudinal axis, said liner having a polygonal cross section;

(b) placing a cage comprised of a pair of contaminant barrier end walls spaced from each other and a peripheral wall interconnecting said end walls into said mold liner and affixing said cage in position therein, said cage having a polygonal cross section, said mold liner and said cage defining a casting space therebetween for casting a peripheral contaminant barrier wall of polygonal cross section and substantially constant thickness;

(c) rotating said mold, mold liner and cage about said longitudinal axis;

(d) injecting a castable contaminant barrier material into said polygonal wall casting space to centrifugally cast said peripheral contaminant barrier wall of a desired wall thickness;

(e) injecting a castable hazardous waste material into the interior of said cage and centrifugally casting same therein; and (f) removing the resulting casting comprised of said cage and said castable materials from said mold.

2. The method of claim 1, comprising the further step of removing, during said rotating of said mold, excess fluid which collects at the upper portion of said polygonal wall casting space as said space is filled with castable contaminant barrier material.

3. The method of claim 2 comprising the further step of removing, during said rotating of said mold, excess fluid which collects at the upper portion of said interior of said cage as said interior is filled with castable hazardous waste material.

4. A centrifugally formed casting comprising:

(a) two spaced contaminant barrier end walls;

(b) a consumable cage wall of polygonal cross-sectional configuration interconnecting said end walls;

(c) a cast contaminant barrier peripheral wall of substantially constant wall thickness extending between said end walls and forming an outer wall of the casting having a polygonal cross sectional configuration of substantially constant thickness; and (d) a cast volume of hazardous waste material disposed inside of said consumable cage wall and extending between said contaminant barrier end walls.

5. Apparatus for centrifugally forming layered castings comprised of a contaminant barrier layer and castable hazardous waste disposed therein comprising:

(a) a split casting mold which is mounted on a support for rotation around a longitudinal axis;

(b) a split mold liner disposed in said casting mold adjacent the inside wall face thereof, said liner having an interior face of polygonal cross section;

(c) a cage comprised of a pair of contaminant barrier end walls spaced from each other and a peripheral wall interconnecting said end walls affixed in position in said mold liner, said cage having a polygonal cross section, said mold liner and said cage defining a casting space therebetween for casting a peripheral contaminant barrier wall of polygonal cross section and substantially constant thickness;

(d) means for rotating said mold, mold liner and cage about said longitudinal axis;

(e) a mandrel for feeding castable material into said mold during rotation of said mold, said mandrel having a first discharge port for feeding contaminant barrier material into said contaminant barrier casting space and a second discharge port for feeding castable waste material into a waste material casting space in the interior of said cage; and (f) means for moving said casting mold relative to said mandrel between a first position and a second position in which the discharge ports of said mandrel are disposed in said contaminant barrier casting space and in said waste material casting space.

6. The apparatus of claim 5, wherein said longitudinal axis is oriented in a substantially vertical direction.

7. The apparatus of claim 6, wherein said mandrel is stationarily mounted above said mold and said means for moving said mold relative to said mandrel comprises an elevator.

8. The apparatus of claim 7, further comprising means for sealing fluid connections between said mandrel discharge ports and mating fluid reception apertures in the upper one of said contaminant barrier end walls when said mold is in its centrifugal casting position.

9. The apparatus of claim 5 wherein said mold has an outer wall and an inner wall defining an excess fluid receiving chamber therebetween and further comprising means for delivering fluid collected in an unfilled portion of said contaminant barrier casting space as said space is filled with contaminant barrier material to said fluid receiving chamber.

10. The apparatus of claim 9 further comprising means for delivering fluid collected in an unfilled portion of said waste material casting space as said space is filled with waste material to said fluid receiving chamber.

* * * * *